US007798943B1

(12) United States Patent
Tsai

(10) Patent No.: US 7,798,943 B1
(45) Date of Patent: Sep. 21, 2010

(54) EXERCISING DEVICE

(76) Inventor: Cheng-Ta Tsai, 7F-1, No. 298, Rueiguang Rd., Neihu Dist., Taipei (TW)

( * ) Notice: Subject to any disclaimer, the term of this patent is extended or adjusted under 35 U.S.C. 154(b) by 0 days.

(21) Appl. No.: 12/536,392

(22) Filed: Aug. 5, 2009

(51) Int. Cl.
*A63B 22/00* (2006.01)

(52) U.S. Cl. ..... 482/70; 482/121

(58) Field of Classification Search ..... 482/51, 482/52, 53, 70, 71, 79, 80, 110, 121, 122, 482/126, 146, 147, 148, 907; 434/253; 472/29, 472/30, 31, 32
See application file for complete search history.

(56) References Cited

U.S. PATENT DOCUMENTS

| | | | | |
|---|---|---|---|---|
| 5,222,928 | A * | 6/1993 | Yacullo | 482/71 |
| 5,749,811 | A * | 5/1998 | Wilson | 482/71 |
| 6,368,254 | B1 * | 4/2002 | Wall | 482/71 |
| 6,786,850 | B2 * | 9/2004 | Nizamuddin | 482/51 |
| 7,090,621 | B2 * | 8/2006 | Loane | 482/71 |
| 7,294,100 | B2 * | 11/2007 | Bull | 482/51 |
| 7,419,459 | B2 * | 9/2008 | Van Straaten | 482/70 |
| 7,438,673 | B1 * | 10/2008 | Jones | 482/71 |
| D589,573 | S * | 3/2009 | McVay et al. | D21/668 |
| 7,556,592 | B2 * | 7/2009 | Nizam | 482/70 |
| 7,641,603 | B2 * | 1/2010 | Lacher | 482/134 |
| 2004/0053752 | A1 * | 3/2004 | Yang | 482/70 |
| 2004/0241631 | A1 * | 12/2004 | Nizamuddin | 434/253 |
| 2006/0252616 | A1 * | 11/2006 | Gerschefske | 482/142 |
| 2007/0117693 | A1 * | 5/2007 | Ilioi | 482/121 |

* cited by examiner

*Primary Examiner*—Loan Thanh
*Assistant Examiner*—Tam Nguyen
(74) *Attorney, Agent, or Firm*—Pai Patent & Trademark Law Firm; Chao-Chang David Pai

(57) ABSTRACT

An exercising device has two rails, two feet, two sliding footrests, an articulated assembly, at least one resilient member and two handles. The rails are parallel. The feet are mounted on the rails. The sliding footrests are mounted slidably on the rails. The articulated assembly is mounted on the rails and is connected pivotally to the sliding footrests. The handles are mounted detachably on the articulated assembly. The exercising device allows conditioning of a neck, arms, thighs, abdomen and back, especially vastus lateralis and vastus medialis muscles of the thighs.

11 Claims, 9 Drawing Sheets

EXERCISING DEVICE

BACKGROUND OF THE INVENTION

1. Field of the Invention

The present invention relates to an exercising device, and more particularly to an exercising device that allows an exerciser for conditioning a neck, arms, abdomen, and thighs, especially vastus lateralis and vastus medialis muscles of the thighs.

2. Description of Related Art

Generally, assistant devices such as physical education and recreation (PER) machines (i.e. butterfly machine), chest-press machines, biceps-curl machines, triceps-press-down machines, abdominal machines or the like are used to condition an upper body. Swimming and running may also be performed to condition upper and lower body muscles and general fitness, but specific lower body muscles may be hard to target during exercise. Therefore, using conventional machines and exercisers, the upper body may be more muscular than the lower body.

Cross trainers, exercise bikes and treadmill can be used for conditioning thighs, such exercise focuses on quadriceps femoris at a front part of the thigh. Therefore, conditioning vastus lateralis and vastus medialis is difficult or two specific machines must be used.

To overcome the shortcomings, the present invention provides an exercising device to mitigate or obviate the aforementioned problems.

SUMMARY OF THE INVENTION

The main objective of the invention is to provide an exercising device for conditioning a neck, arms, abdomen, back and thighs, especially vastus lateralis and vastus medialis muscles of the thighs.

An exercising device in accordance with present invention has two rails, two feet, two sliding footrests, an articulated assembly, at least one resilient member and two handles. The rails are parallel. The feet are mounted on the rails. The sliding footrests are mounted slidably on the rails. The articulated assembly is mounted on the rails and is connected pivotally to the sliding footrests. The handles are mounted detachably on the articulated assembly.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
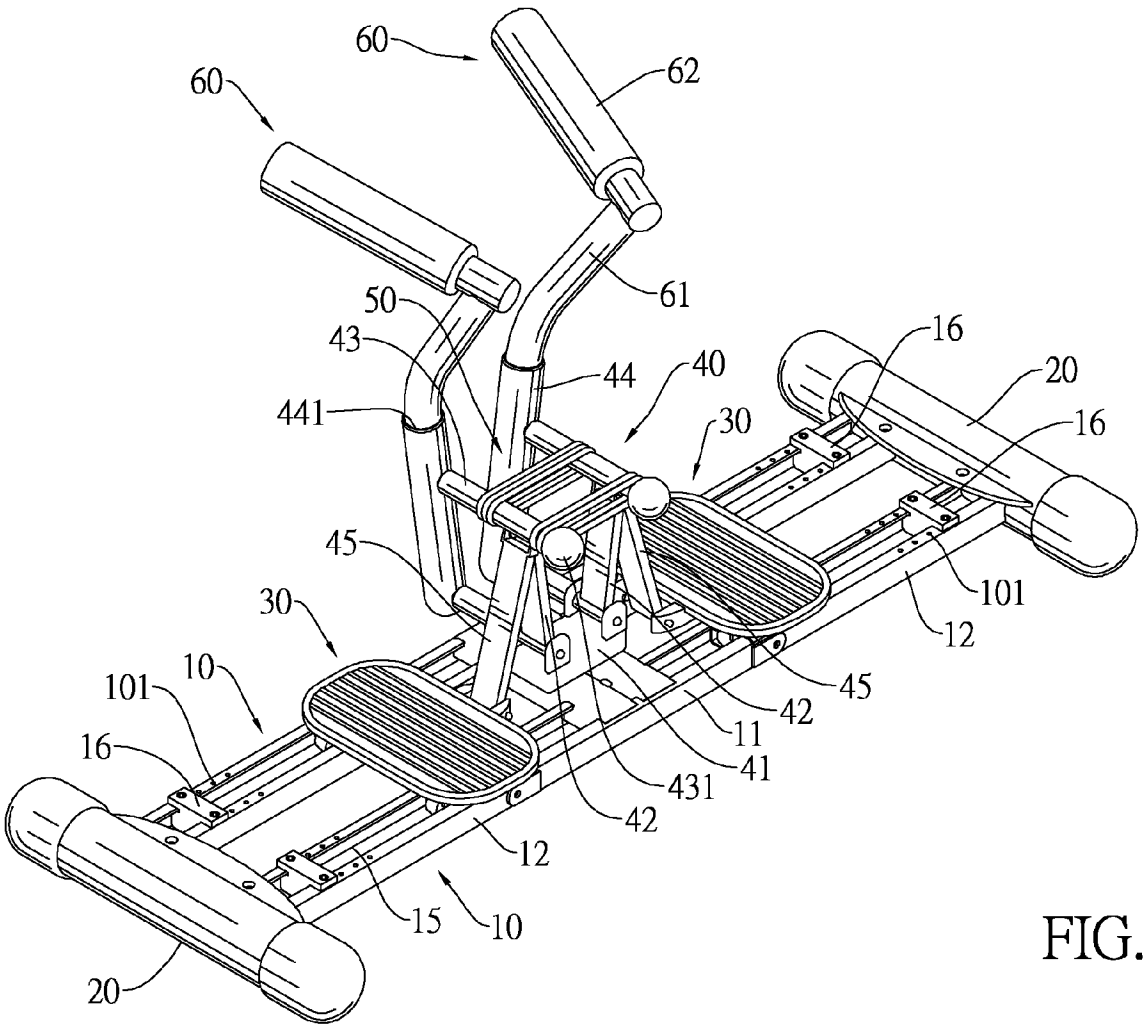
FIG. 1 is a perspective view of a first embodiment of an exercising device in accordance with the present invention.
Figure 2:
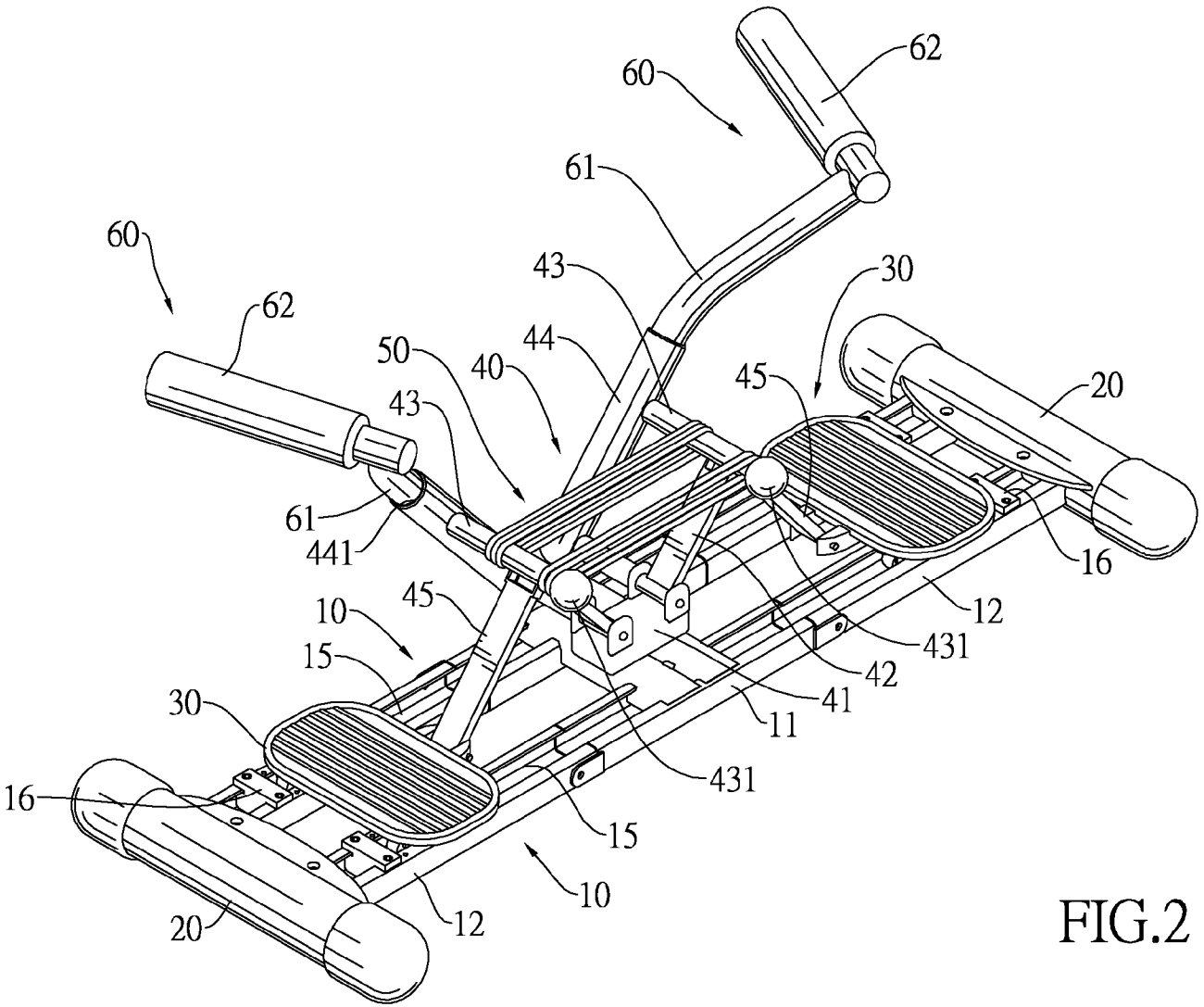
FIG. 2 is an operational perspective view of the exercising device in FIG. 1.
Figure 3:
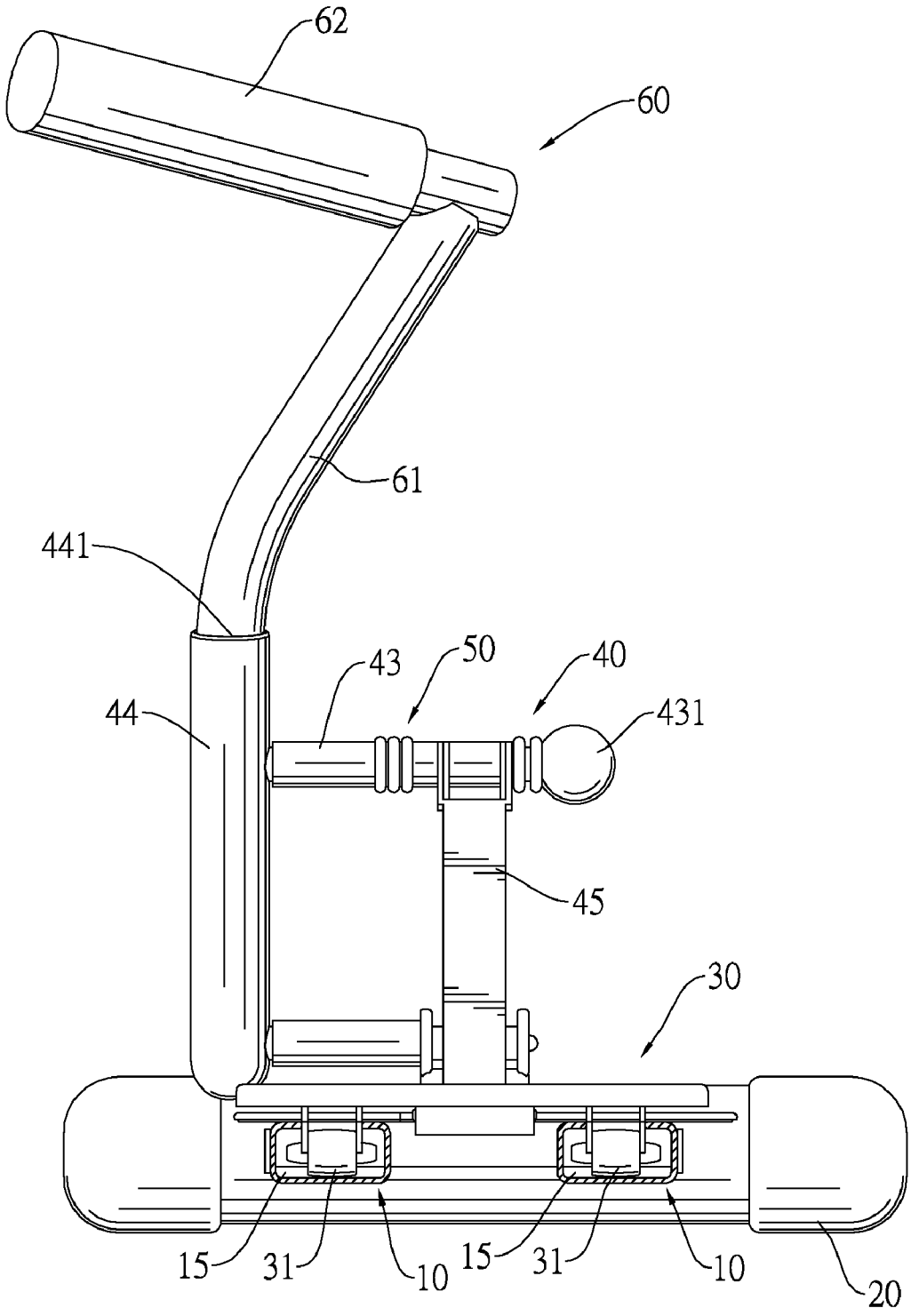
FIG. 3 is side view of the exercising device in FIG. 1.

With reference to FIGS. 1 to 3, a first embodiment of an exercising device in accordance with the present invention comprises two rails (10), two feet (20), two sliding footrests (30), an articulated assembly (40), at least one resilient member (50) and two handles (60).

Figure 4:
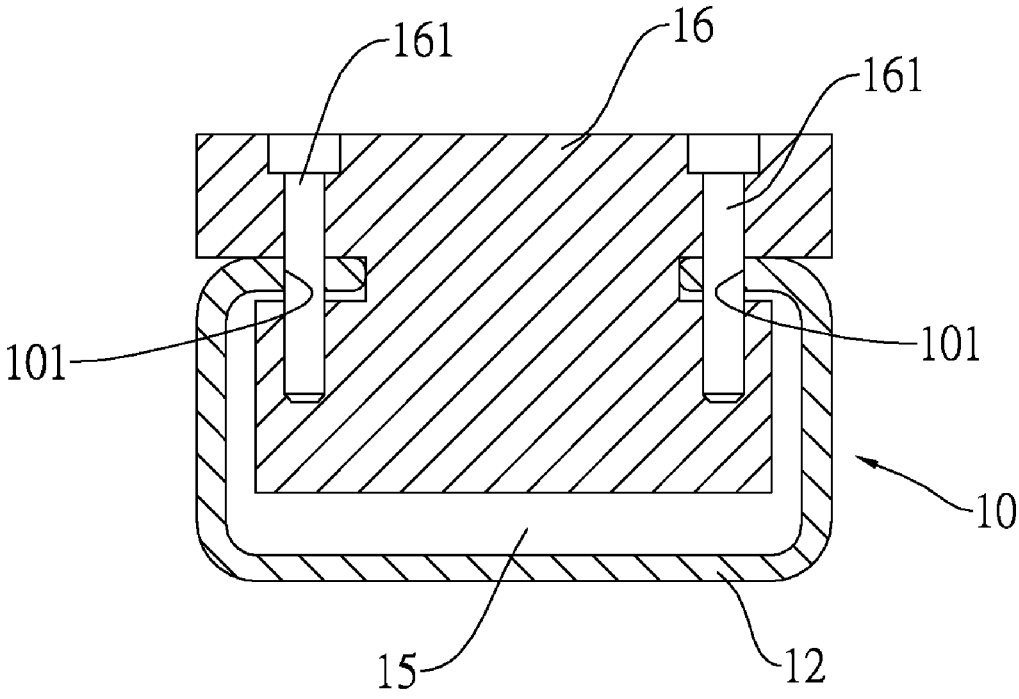
FIG. 4 is an enlarged side view in partial section of a stopper mounted in a rail of the exercising device in FIG. 1.

With further reference to FIG. 4, the rails (10) are parallel to each other and each rail (10) may be foldable and have a central section (11) and two outside sections (12). The central section (11) has two ends. The outside sections (12) are pivotally connected respectively to the ends of the central section (11). Each rail (10) has two ends and a top surface and may further have a sliding slot (15), two sets of fastening elements (101) and two stoppers (16). The sliding slot (15) is defined longitudinally in the top surface of the rail (10) and may be defined in the central section (11) and outside sections (12). The sets of the fastening elements (101) are defined in the top surface respectively near the ends of the rail (10), are arranged longitudinally and may be two sets of threaded holes. The stoppers (16) are mounted detachably in the sliding slot (15) respectively near the ends of the rail (10) and correspond to the sets of the fastening elements (101). Each stopper (16) has at least one fastener (161) mounted through the stopper (16) and detachably mounted respectively in at least one of the fastening elements (101) of a corresponding set. The at least one fastener (161) may be at least one bolt screwed respectively in the at least one threaded hole of a corresponding set. Mounting the stoppers (16) to different fastening elements (101) changes locations of the stoppers (16) relative to the rail (10).

The feet (20) are mounted respectively on the ends of each rail (10) to connect the rails (10) together and may stand on the ground.

The sliding footrests (30) are mounted slidably on the rails (10), may slide between the stoppers (16) of each rail (10) and each sliding footrest (30) may have a bottom and two slides (31). The slides (31) are mounted securely on the bottom of the sliding footrest (30), correspond to the rails (10) and are slidably mounted respectively in the sliding slots (15) of the rails (10). Each slide (31) selectively abuts one stopper (16) of a corresponding rail (10) to prevent over-extension of an exerciser's legs and prevent injury to tendons and muscles. The slides (31) may be rollers that are capable of sliding and rolling in the sliding slots (15) to facilitate movements of the sliding footrests (30).

The articulated assembly (40) is mounted on the rails (10), is connected pivotally to the sliding footrests (30) and has a mounting bracket (41), two inside links (42), two pivot rods (43) and two outside links (45).

The mounting bracket (41) is mounted on the rails (10) and may be mounted on the central sections (11) of the rails (10).

The inside links (42) are mounted pivotally on the mounting bracket (41).

The pivot rods (43) are pivotally connected respectively to the inside links (42) and each pivot rod (43) has a connecting end and a free end and may further have an enlarged boss (431) and a sleeve (44). The free end is opposite to the connecting end. The enlarged boss (431) is formed on the free end. The sleeve (44) is formed on the free end of the pivot rod (43) and has a mounting hole (441) defined in the sleeve (44).

The outside links (45) are pivotally connected respectively to the pivot rods (43) and are pivotally connected respectively to the sliding footrests (30).

The at least one resilient member (50) may be made of rubber, is mounted between the pivot rods (44), selectively provides a resilient force pulling the pivot rods (44) inward toward each other and may be limited by the enlarged bosses (431) to prevent the at least one resilient member from falling. The at least one resilient member (50) may be at least one elastic band mounted around the pivot rods (44).

The handles (60) correspond to and are detachably mounted respectively on the pivot rods (43) and each handle (60) may have a mounting shaft (61) and a grip (61).

The mounting shaft (61) is mounted in the mounting hole (441) of a corresponding sleeve (44).

The grip (62) is mounted on the mounting shaft (61) and may have a sheath.

Figure 5:
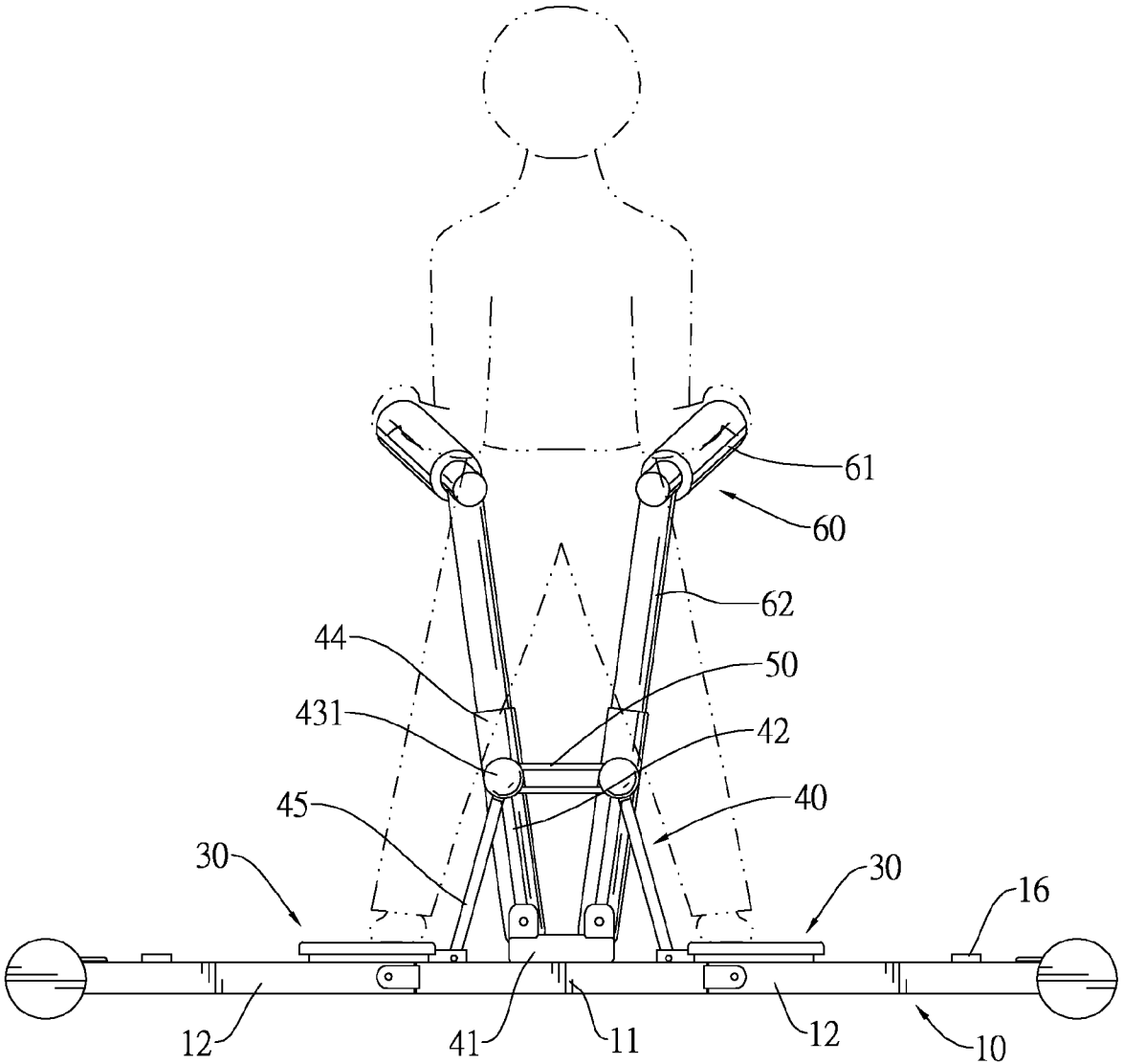
FIG. 5 is an operational rear view of an exerciser standing on the exercising device in FIG. 1.
Figure 6:
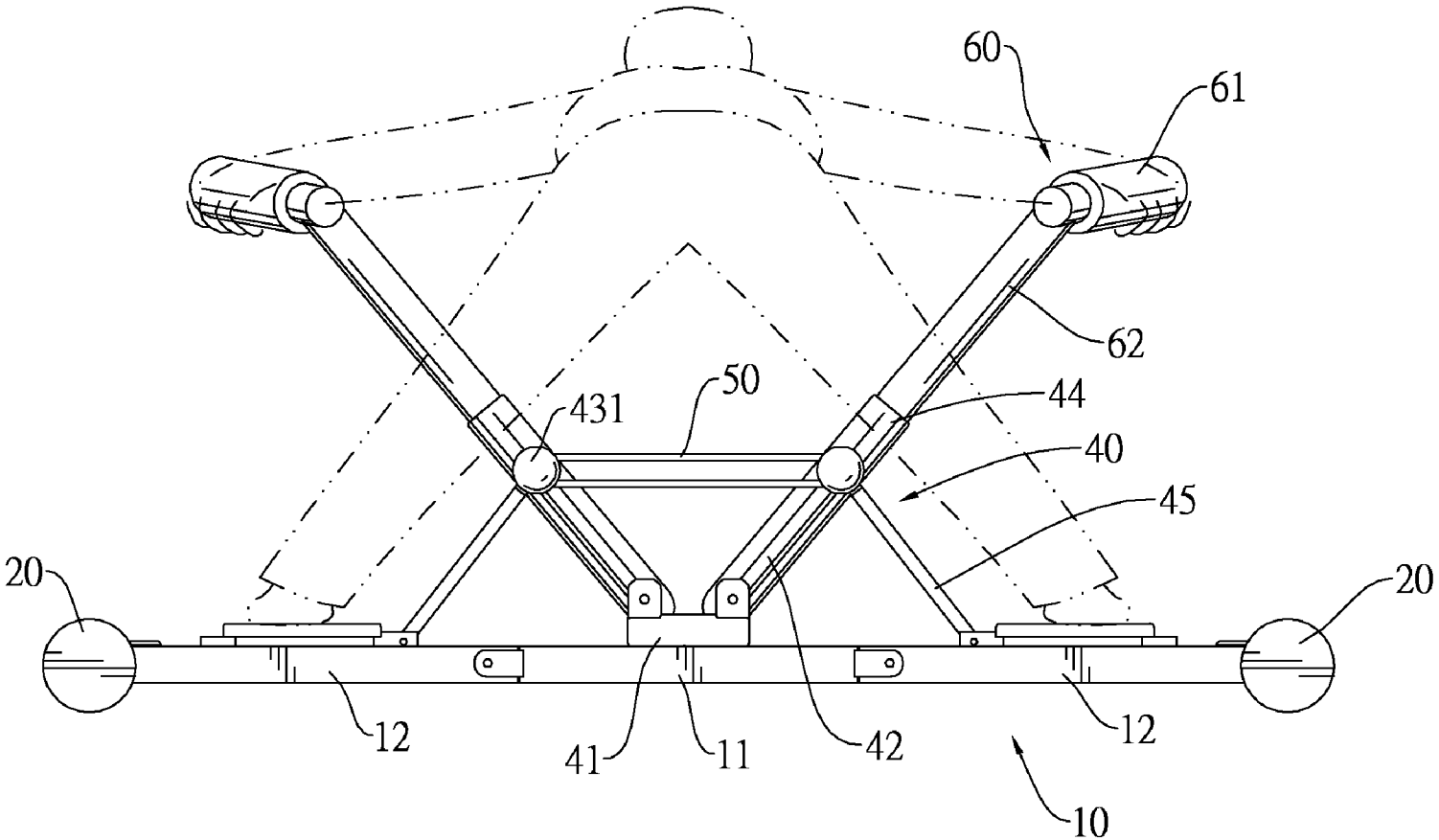
FIG. 6 is an operational front view of the exerciser operating on exercising device in FIG. 2 stooping and stretching out his/her arms and legs against the resilient members.

With further reference to FIGS. 5 and 6, an exerciser using the exercising device stands on the sliding footrests (30) and grasps the grips (62). Then, the handles (60) and sliding footrests (30) are parted working against the resilient force of the resilient member (50) and the exerciser stoops and looks up. When the exerciser retracts the legs and pulls the handles (60) inwards, the at least one resilient member (50) provides resilient force in assistance. Thus, the neck, arms, inside and outside muscles of the thighs, abdomen and back are all conditioned.

Figure 7:
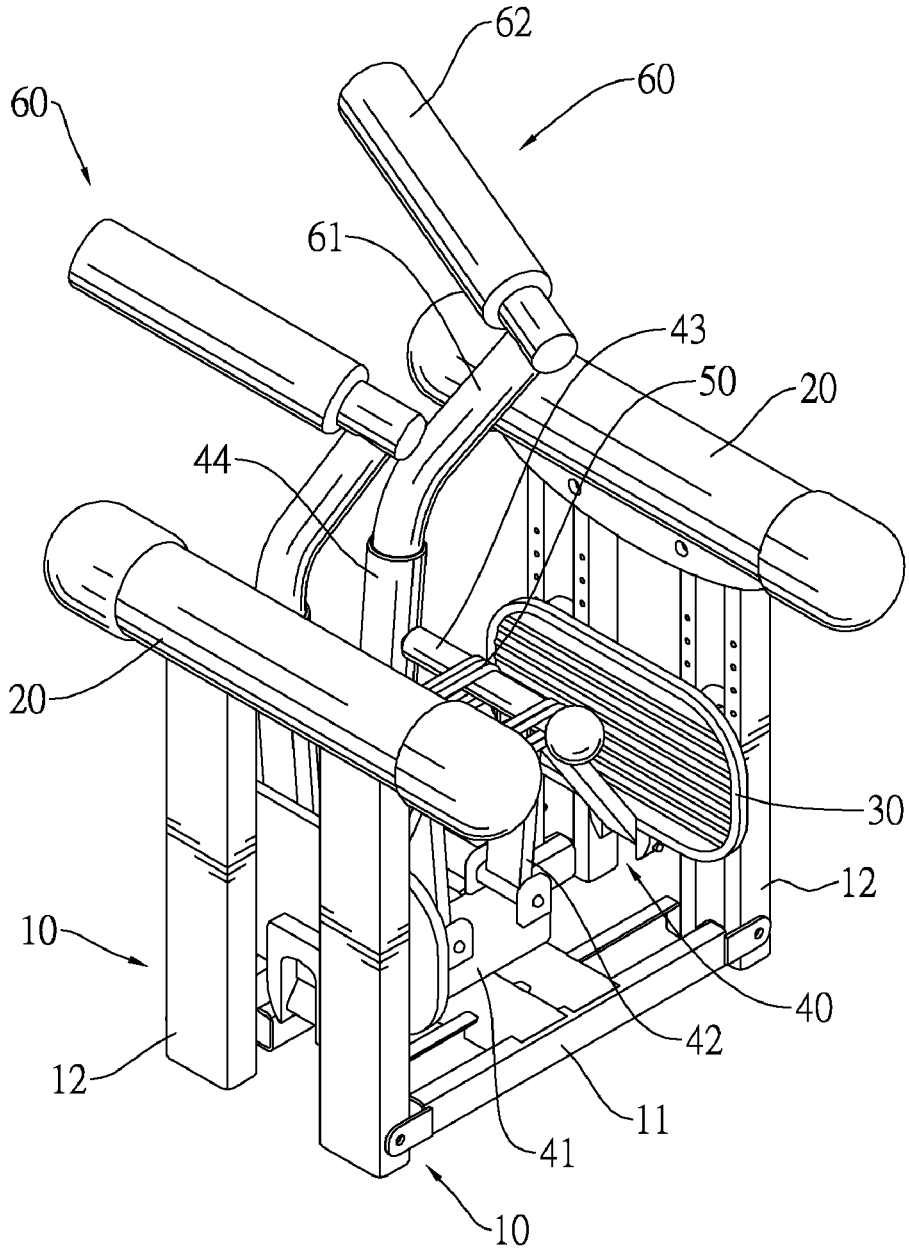
FIG. 7 is an operational perspective view of the exercising device in FIG. 1 folded into a compact configuration.
Figure 8:
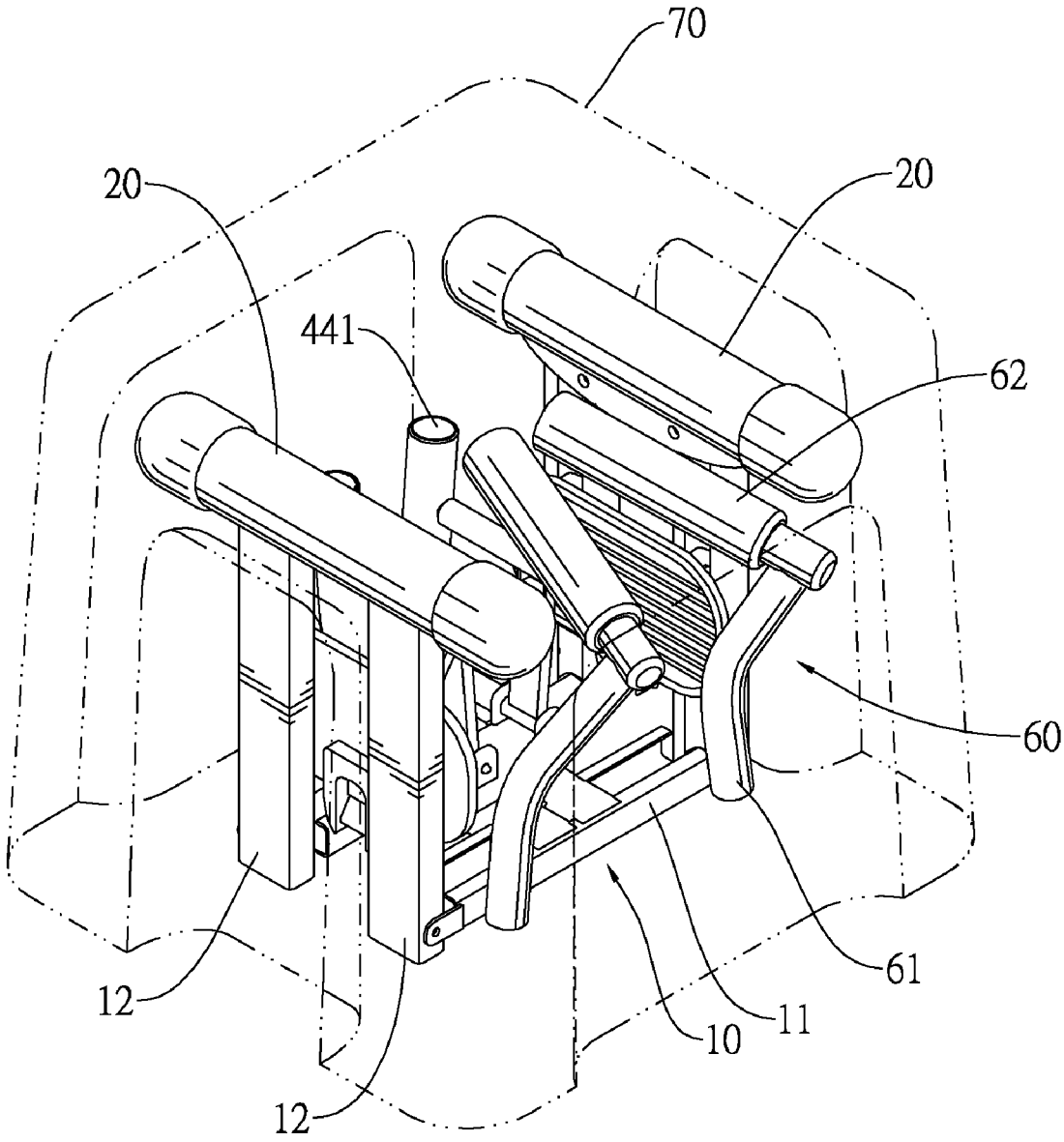
FIG. 8 is an operational perspective of the exercising device in FIG. 7 that with handles detached for storage or transportation.

With further reference to FIGS. 7 and 8, to store or carry the exercising device, the rails (10) are folded to fold the exercising device into a compact configuration. Further, the handles (60) are detached to reduce a height of the exercising device so that the exercising device may be packaged into a box (70) for storage or transportation.

Figure 9:
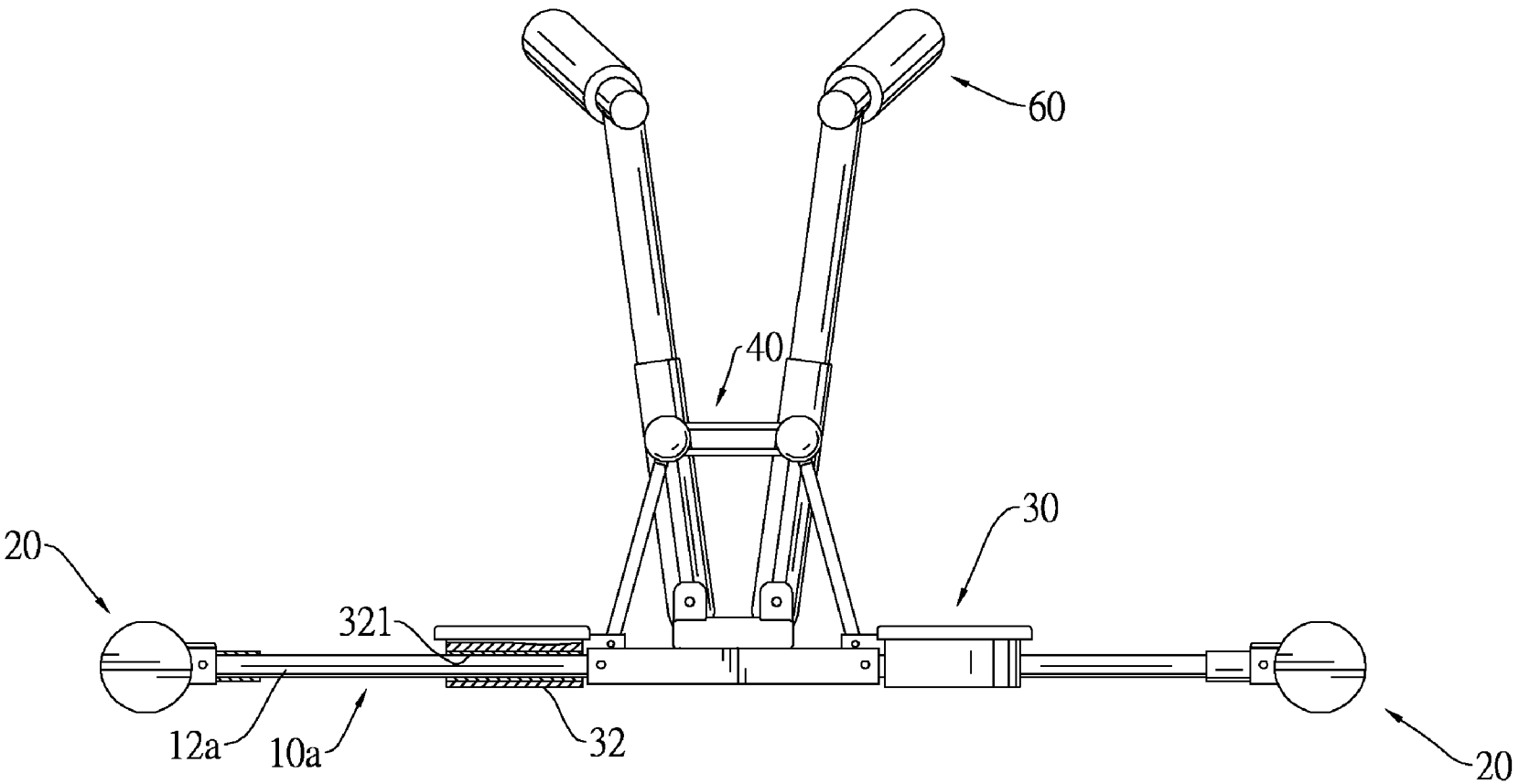
FIG. 9 is a front view of a second embodiment of the exercising device in accordance with the present invention.

With further reference to FIG. 9, a second embodiment of an exercising device is similar to the first embodiment. However the outside sections (12*a*) of each rail (10*a*) of the second embodiment are rods. Each slide (32) of each sliding footrest (30) is a tube having a sliding hole (321) defined through the tube and mounted slidably around the one rod of a corresponding rail (10*a*).

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An exercising device comprising:

two rails parallel to each other and having two ends and a top surface;

two feet mounted respectively on the ends of the each rail;

two sliding footrests mounted slidably on the rails;

an articulated assembly mounted on the rails, connected pivotally to the sliding footrests and having a mounting bracket mounted on the rails;

two inside links mounted pivotally on the mounting bracket;

two pivot rods pivotally connected respectively to the inside links and each pivot rod having a connecting end and a free end opposite to the connecting end; and two outside links pivotally connected respectively to the pivot rods and pivotally connected respectively to the sliding footrests;

at least one resilient member mounted between the pivot rods and selectively providing a resilient force pulling the pivot rods inward toward each other; and two handles corresponding to and detachably mounted respectively on the pivot rods.

2. The exercising device as claimed in claim 1, wherein each pivot rod of the articulated assembly further has a sleeve formed on the free end of the pivot rod and having a mounting hole defined in the sleeve; and each handle has a mounting shaft mounted in the mounting hole of a corresponding sleeve; and a grip mounted on the mounting shaft.

3. The exercising device as claimed in claim 1, wherein the rails are foldable.

4. The exercising device as claimed in claim 3, wherein each rail has a central section having two ends; and two outside sections pivotally connected respectively to the ends of the central section.

5. The exercising device as claimed in claim 2, wherein each pivot rod further has an enlarged boss formed on the free end and limiting the at least one resilient member.

6. The exercising device as claimed in claim 1, wherein the at least one resilient member is at least one elastic band mounted around the pivot rods.

7. The exercising device as claimed in claim 1, wherein the at least one resilient member is made of rubber.

8. The exercising device as claimed in claim 1, wherein each rail further has a sliding slot defined longitudinally in the top surface of the rail; and each sliding footrest has a bottom and two slides mounted securely on the bottom, corresponding to the rails and slidably mounted respectively in the sliding slots of the rails.

9. The exercising device as claimed in claim 1, wherein each rail further has two sets of fastening elements defined in the top surface respectively near the ends of the rail and arranged longitudinally; and two stoppers mounted detachably in the sliding slot respectively near the ends of the rail, corresponding to the sets of the fastening elements and each stopper selectively abutting one slide of one sliding footrest and having at least one fastener mounted through the stopper and detachably mounted respectively in at least one of the fastening elements of a corresponding set.

10. The exercising device as claimed in claim 1, wherein the sets of the fastening elements of each rail are two sets of threaded holes; and the least one fastener of each stopper is at least one bolt corresponding to the threaded holes.

11. The exercising device as claimed in claim 3, wherein each outside section of each rail are rods;

each sliding footrest has a bottom and two slides mounted securely on the bottom, corresponding to the rails; and each slide is a tube having a sliding hole defined through the tube and mounted slidably around one rod of a corresponding rail.

* * * * *